US006294746B1

(12) United States Patent
Yee

(10) Patent No.: US 6,294,746 B1
(45) Date of Patent: Sep. 25, 2001

(54) ROTARY SWITCH

(76) Inventor: Vincent Yee, 14122 D. Marquesas Way, Marina Del Rey, CA (US) 90292

( * ) Notice: Subject to any disclaimer, the term of this patent is extended or adjusted under 35 U.S.C. 154(b) by 0 days.

(21) Appl. No.: 09/572,178

(22) Filed: May 17, 2000

(51) Int. Cl.[7] ..... H01H 19/10

(52) U.S. Cl. ..... 200/565; 200/11 R; 200/60; 200/336

(58) Field of Search ..... 200/11 R–11 K, 200/60, 564, 565, 567, 570, 571, 336

(56) References Cited

U.S. PATENT DOCUMENTS

| | | | | |
|---|---|---|---|---|
| 2,498,805 | * | 2/1950 | Gurevsky | 315/313 |
| 2,503,287 | * | 4/1950 | Moore | 200/60 |
| 3,780,245 | * | 12/1973 | Beddow | 200/155 R |
| 4,167,660 | * | 9/1979 | Liedtke | 200/155 R |
| 4,243,853 | * | 1/1981 | Turner | 200/8 R |
| 5,205,640 | | 4/1993 | Shin | 362/205 |
| 5,412,548 | | 5/1995 | Yee | 362/202 |
| 5,588,739 | | 12/1996 | Nakao | 362/205 |
| 5,680,927 | * | 10/1997 | Thornton | 200/565 |
| 5,836,672 | * | 11/1998 | Maglica et al. | 362/183 |

* cited by examiner

*Primary Examiner*—Michael Friedhofer
(74) *Attorney, Agent, or Firm*—Kleinberg & Lerner, LLP

(57) ABSTRACT

A rotary switch and a flashlight incorporating same are described. A cylindrical housing encloses a button-type battery cell and provides a grounded inwardly protruding, inwardly biased resilient wiper. A rotor, movably approximated to the housing, has a generally cylindrical hub defining one or more contact areas on its side surface for selectively electrically connecting a bulb or other device to the battery cell by rotating the rotor relative to the housing. The rotor further defines a retaining tooth which engages a retaining groove on the outer surface of the housing to keep the rotor on the housing. Rotational position is stabilized by cooperation between a the wiper and a contact surface or between the rotor shell and a position key formed on the housing. The rotor hub is configured to house a circuit module for interposing desired electrical functions between the bulb and the battery cell.

3 Claims, 7 Drawing Sheets

ROTARY SWITCH

THE FIELD OF THE INVENTION

The present invention relates generally to portable electrical devices and battery powered devices and more particularly to miniature flashlights and flashers.

THE BACKGROUND ART

Presently available switches for miniature and multifunction flashlights provide for the selection of a limited number of functions and often require electrical continuity between a battery cap, a battery housing and a substantial portion of the switch housing in order to provide a ground. Consequently, the functions of such devices are limited in number and their cost and weight are greater than would be preferred.

It would be helpful to be able to manufacture lighter, less expensive, more versatile miniature electrical devices such as a multifunction flashlight. Such devices might be made more convenient, more practical and more attractive, as well as more reliable and less expensive, if an improved rotary switch were available.

SUMMARY OF THE INVENTION

It is an object of the present invention to provide an inexpensive, compact, convenient rotary switch for selectively operating a miniature flashlight and especially for a combination of a flashlight with a lantern or flasher.

It is an additional object of the present invention to provide such a switch in a flashlight or similar article which uses metal sparingly and which can be made of mostly transparent materials.

In accordance with these objects and with others which will be described and which will become apparent, an exemplary embodiment of a rotary switch in accordance with the present invention includes a housing, a rotor approximated to the housing, an electrically conductive wiper disposed on the housing, and an electrically conductive contact surface disposed on the rotor. The wiper and the contact surface are movable between a first relative position and a second relative position. An electrical circuit is closed comprising the wiper and the contact surface in series when the wiper and the contact surface are in the first relative position. The electrical circuit is opened when the wiper and the contact surface are in the second relative position. The housing defines an axis of rotation, the rotor being rotatable about the axis of rotation with respect to the housing to provide the first and second relative positions of the wiper and the contact surface. The wiper is confined at an angular position about the axis of rotation on the housing. The contact surface is confined at an angular position about the axis of rotation on the rotor, such that, with rotation of the rotor about the axis of rotation with respect to the housing, the wiper and the contact surface are moved between the first and second relative positions. The wiper and the contact surface when in the first relative position define a thrust axis. The wiper is supported on the housing with respect to the thrust axis, and the contact surface is supported on the rotor with respect to the thrust axis, such that the wiper and the contact surface are urged into mutual electrical contact when in the first relative position. The wiper and the contact surface when in the first relative position cooperate to provide resistance to rotation of the rotor relative to the housing, whereby the first relative position is stabilized.

Also in accordance with the objects of the present invention, another exemplary embodiment of a rotary switch in accordance with the present invention comprises a resilient wire.

Also in accordance with the objects of the present invention, another exemplary embodiment of a rotary switch in accordance with the present invention comprises a resilient wire having a first end, a second end, and a middle portion, the middle portion being biased toward the contact surface on the thrust axis.

Also in accordance with the objects of the present invention, in another exemplary embodiment of a rotary switch in accordance with the present invention, the middle portion of the wiper resilient wire defines a wiper contour, the contact surface defines a contact surface contour, and the contact surface contour is complementary to the wiper contour.

Also in accordance with the objects of the present invention, in another exemplary embodiment of a rotary switch in accordance with the present invention, the middle portion of the wiper resilient wire is movable between a relatively compressed position and a relatively relaxed position on the thrust axis relative to the contact surface, the wiper resilient wire being in the relatively relaxed position when the wiper and the contact surface are in the first relative position.

Also in accordance with the objects of the present invention, in another exemplary embodiment of a rotary switch in accordance with the present invention, the housing forms a cylindrical end; the cylindrical end has an outer surface defining a circumferentially oriented circular retaining groove; the rotor forms a cylindrical shell; the shell defines a retaining tooth; and the retaining tooth is approximated to the retaining groove to affix the rotor to the housing.

Also in accordance with the objects of the present invention, another exemplary embodiment of a rotary switch in accordance with the present invention comprises a housing; a rotor approximated to the housing; an electrically conductive wiper disposed on the housing; an electrically conductive contact surface disposed on the rotor; the wiper and the contact surface being movable between a first relative position and a second relative position; an electrical circuit being closed comprising the wiper and the contact surface in series when the wiper and the contact surface are in the first relative position, the electrical circuit being opened when the wiper and the contact surface are in the second relative position; the housing defining an axis of rotation, the rotor being rotatable about the axis of rotation with respect to the housing to provide the first and second relative positions of the wiper and the contact surface; the wiper being confined at an angular position about the axis of rotation on the housing, and the contact surface being confined at an angular position about the axis of rotation on the rotor, such that, with rotation of the rotor about the axis of rotation with respect to the housing, the wiper and the contact surface are moved between the first and second relative positions; the wiper and the contact surface when in the first relative position defining a thrust axis; the wiper being supported on the housing with respect to the thrust axis, and the contact surface being supported on the rotor with respect to the thrust axis, such that the wiper and the contact surface are urged into mutual electrical contact when in the first relative position; the housing and the rotor cooperating to provide resistance to rotation of the rotor relative to the housing when the wiper and the contact surface are in the first relative position, whereby the first relative position is stabilized.

Also in accordance with the objects of the present invention, in another exemplary embodiment of a rotary switch in accordance with the present invention comprises a wherein the housing defines a position key, the rotor defines a shell, and the position key and the shell cooperate to provide resistance to rotation of the rotor relative to the housing when the wiper and the contact surface are in the first relative position.

Also in accordance with the objects of the present invention, in another exemplary embodiment of a rotary switch in accordance with the present invention, the housing forms a cylindrical end; the position key projects radially outward from the cylindrical end; the rotor forms a cylindrical shell; the rotor is approximated to the cylindrical end; and the position key contacts the shell to provide resistance to rotation of the rotor relative to the housing when the wiper and the contact surface are in the first relative position.

Also in accordance with the objects of the present invention, in another exemplary embodiment of a rotary switch in accordance with the present invention, the housing forms a cylindrical end; the cylindrical end has an outer surface defining a circumferentially oriented circular retaining groove; the rotor forms a cylindrical shell; the shell defines a retaining tooth; and the retaining tooth is approximated to the retaining groove to affix the rotor to the housing.

Also in accordance with the objects of the present invention, in another exemplary embodiment of a rotary switch in accordance with the present invention, a plurality of electrically conductive contact surfaces are disposed on the rotor; the wiper and the contact surface being movable between a plurality of relative positions; an electrical circuit being defined comprising the wiper and one of the plurality of contact surfaces in series when the wiper and the one of the plurality of contact surface are in each of the relative positions, the electrical circuit being defined as open when the wiper and the contact surface are in one of the relative positions, whereby the rotary switch is positionable to select any of a plurality of electrical functions or none of them.

It is an advantage of the present invention that the switch housing and the rotor may both be made inexpensively of a nonconducting material such as a thermoplastic or paper product. Only the ground wire, the wiper, the electrically conductive contact surfaces and other electrical elements need be made of an electrically conductive material.

It is an additional advantage of the present invention that the rotor may be equipped with two, three, or more contact surfaces, any number of which may be selectively electrically connectable to other electrical elements to provide a desired electrical function, and any number of which may be electrically isolated (or formed of an electrically nonconductive material) to provide one or more "off" switch positions.

It is an additional advantage of the present invention that specific electrical functions can be added or altered, without redesigning the rotary switch, by changing the specifications of the circuit module that is to be used in conjunction with the rotary switch.

BRIEF DESCRIPTION OF THE-DRAWINGS

For a further understanding of the objects and advantages of the present invention, reference should be had to the following detailed description, taken in conjunction with the accompanying drawing, in which like parts are given like reference numbers and wherein.

DESCRIPTION OF A PREFERRED EMBODIMENT OF THE INVENTION

Figure 1:
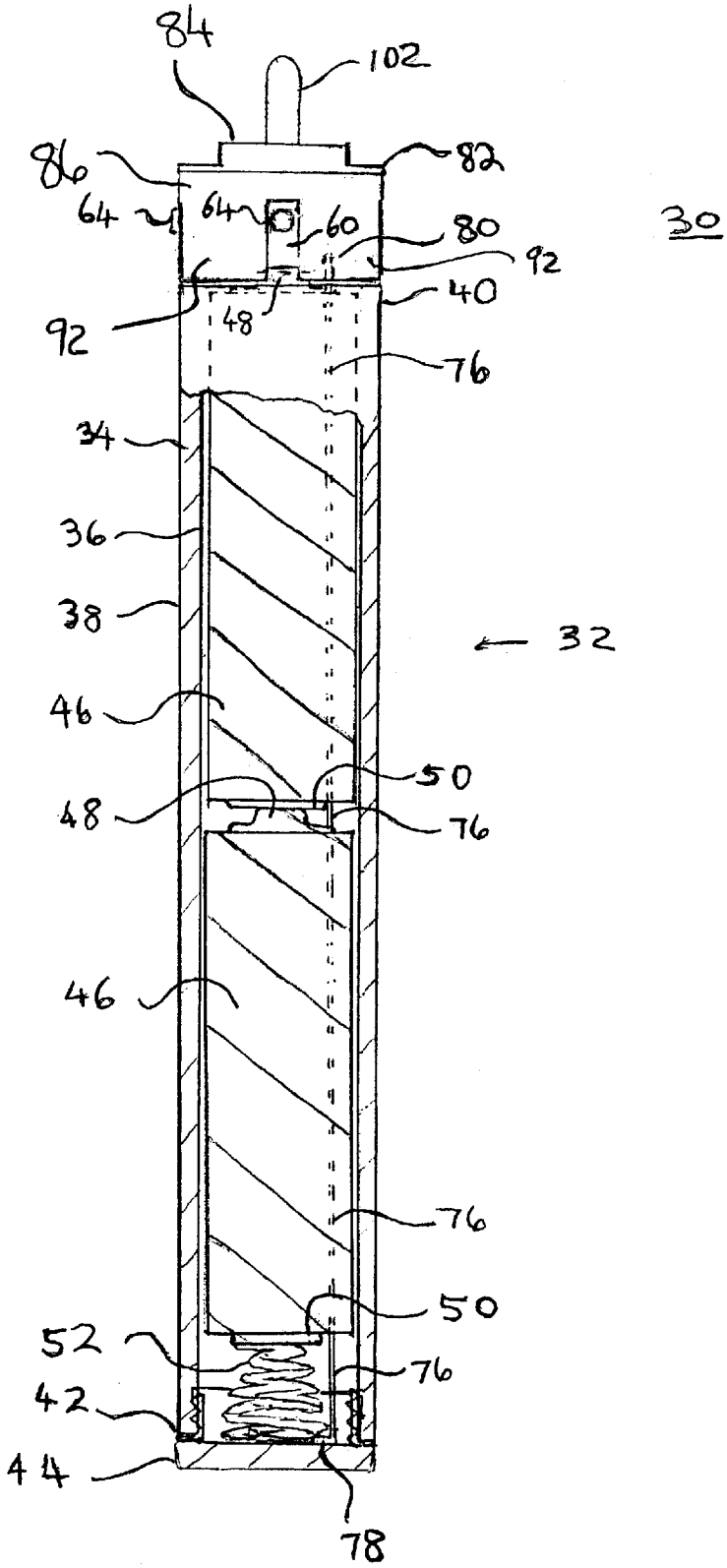
FIG. 1 is a partially cut-away side view of a rotary switch in accordance with the present invention.

The invention will now be described with reference to FIG. 1, which shows a partial cut-away side view of a preferred embodiment of a rotary switch in accordance with the present invention, represented generally by the reference number 30. The rotary switch 30 is shown as being incorporated into the core of a flashlight 32. The flashlight 32 has a cylindrical battery cell housing 34 having a housing inner side surface 36, a housing outer side surface 38, a housing front end 40, and a housing rear end 42.

A cap 44 is securably disposed on the housing rear end 42. The battery cell housing 34 encloses two storage batteries 46 which are oriented with positive button battery terminals 48 oriented toward the housing front end 40 and a negative button battery terminals 50 oriented toward the housing rear end 42. The cap 44 includes an electrically conductive cap spring 52 which is biased to be in contact with the negative button battery terminal 50. A ground wire 76 is disposed in the battery cell housing 34 and has a ground wire rear end 78 electrically connected to the cap spring 52 and a ground wire front end 80 which extends into the housing front end 40.

A generally hollow switch rotor 82 is disposed on the housing front end 40. The switch rotor 82 has a cylindrical rotor shell 86 which defines four circumferentially spaced apart, rearwardly projecting rotor side portions 92 which fit over the housing front end 40. The switch rotor 82 has a rotor front end 84 in which is mounted a miniature light bulb 102. Four positioning prongs 60 project forward from the housing front end 40. Each positioning prong 60 defines a position key 64. In FIG. 1, the position keys 64 are shown which projecting radially outward between adjacent rotor side portions 92.

Figure 2:
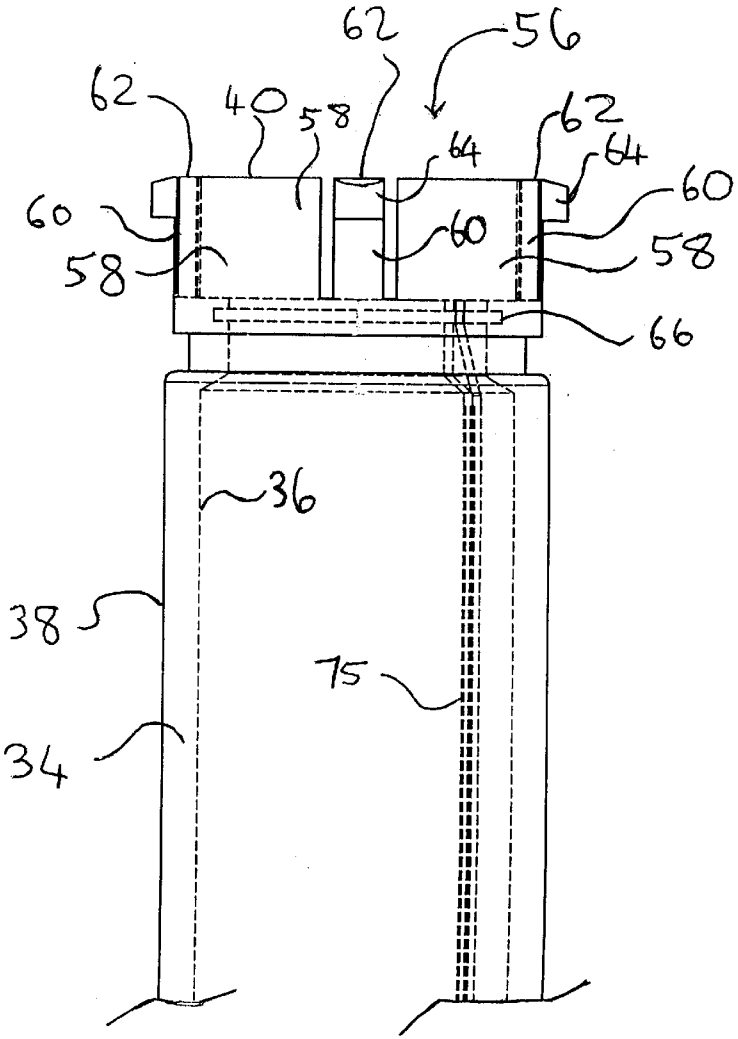
FIGS. 2 AND 3 are partial side sectional views of a rotary switch in accordance with the present invention.
Figure 3:
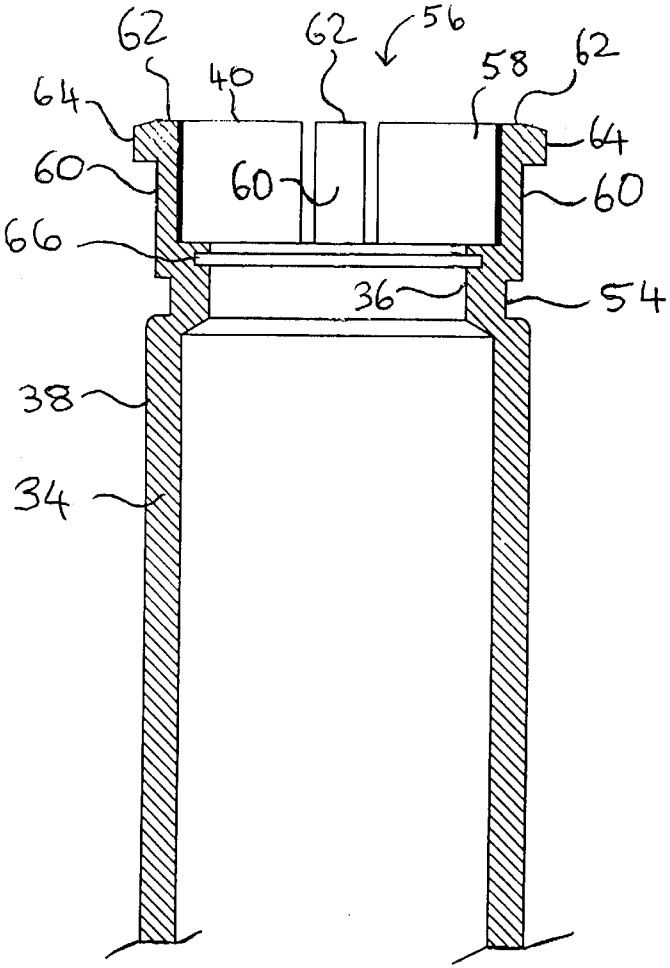

FIGS. 2 and 3 are partial side views of the battery cell housing 34 detailing the housing front end 40. Proximate the housing front end 40, the housing outer side surface 38 defines a circumferentially oriented circular retaining groove 54. The housing front end 40 defines a circular housing front opening 56. The housing front end 40 is longitudinally incised to define four circumferentially spaced-apart housing side portions 58 and four circumferentially spaced-apart positioning prongs 60. Each positioning prong 60 has a prong distal end 62 which forms a position key 64. Each position key 64 projects radially outward beyond the radius defined by the housing outer side surface 38 at the housing front end 40. Proximate the housing front end 40, the housing inner side surface 36 defines a circumferentially oriented arcuate ground wiper stabilizing groove 66. A ground wire channel 75 is inscribed in the housing inner side surface 66.

Figure 4:
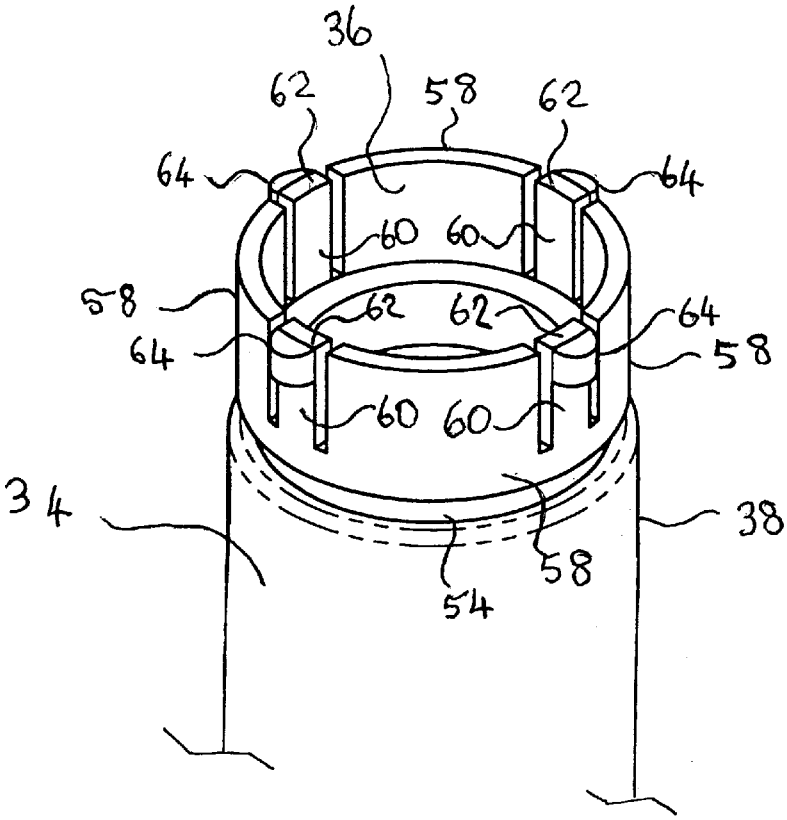
FIG. 4 is a partial perspective view of the housing front end for a rotary switch in accordance with the present invention.

FIG. 4 is a partial perspective view of the battery cell housing 34 detailing the housing front end 40. The retaining groove 54, housing front opening 56, housing side portions 58, positioning prongs 60, prong distal ends 62, and position keys 64 are shown.

Figure 5:
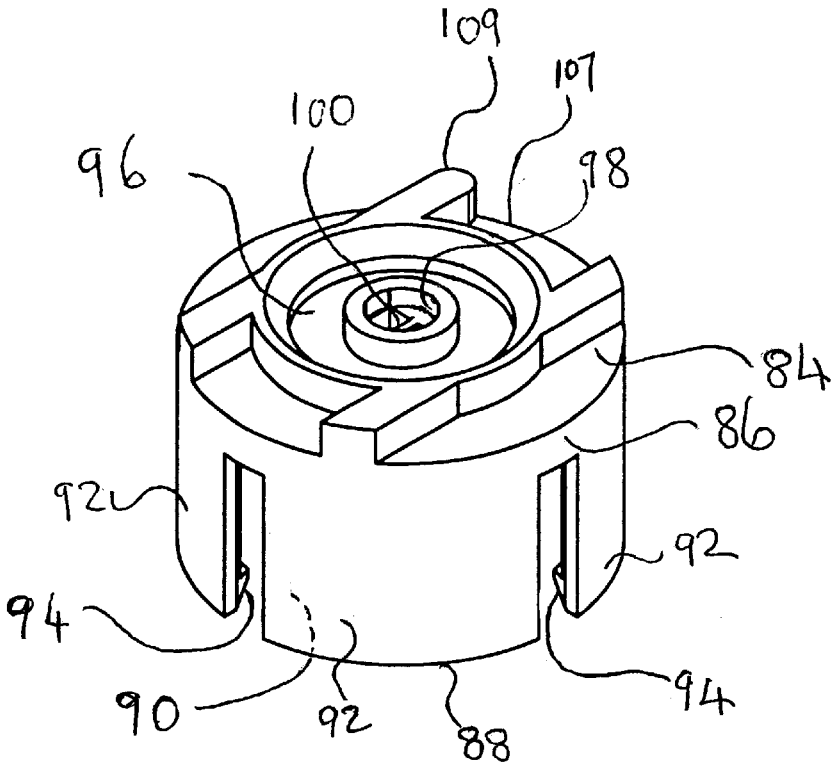
FIG. 5 is a partial perspective view of a rotor for a rotary switch in accordance with the present invention.

FIG. 5 is a partial perspective view showing a generally hollow switch rotor 82 having a rotor front end 84 and a cylindrical rotor shell 86 which extends rearward to form a rotor rear end 88 and to define a rotor inner side surface 90. The rotor rear end 88 is longitudinally incised to form four circumferentially spaced-apart rotor side portions 92. Proximate the rotor rear end 88, each rotor side portion 92 forms a radially inwardly projecting retaining tooth 94. Each rotor side portion 92 is formed of an elastic material and is radially outwardly deformable in response to applied force.

The rotor front end 84 defines a rotor front surface 96, a central portion of which forms a light bulb socket 98 comprising a pair of electrically conductive channels 100 for accommodating a miniature light bulb. The periphery 107 of the rotor front end 84 forms a radially outwardly projecting engagement finger 109, the purpose of which is to provide spline-like rotational coupling to an inwardly-grooved exterior sleeve (not shown) which may be mounted radially outwardly of the switch rotor 82.

Figure 6:
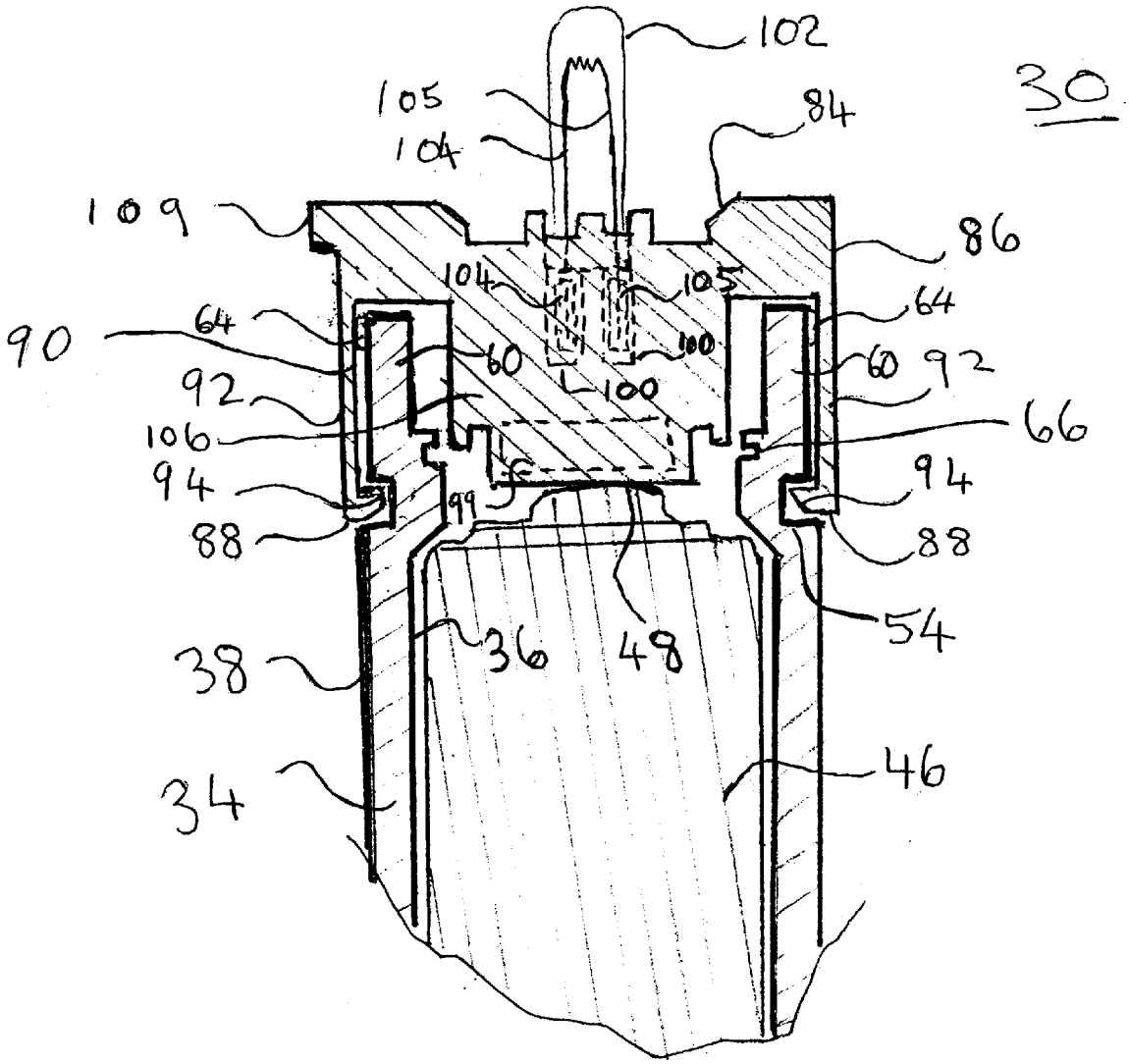
FIG. 6 is a partial side sectional view of a housing front end and a switch rotor approximated thereto to form a rotary switch in accordance with the present invention.

FIG. 6 is a partial side sectional view of the switch 30 showing the rotor 82 mounted on the housing front end 40. Two electrically conductive channels 100 are defined in the rotor front end 84. A miniature bulb 102 has a first bulb lead 104 and a second bulb lead 105. The bulb leads 104 and 105 are respectively inserted in the channels 100.

The rotor has an inner side surface 90 which has an inside diameter at least as great as the outside diameter of the housing outer surface 38 of the housing front end 40. When the switch rotor 82 is mounted on the housing front end 40, the, retaining tooth 94 formed on each elastic rotor side portion 92 interferes with the housing outer surface and the rotor side portion is deformed radially outward. When the rotor switch is urged far enough rearward onto the housing front end 40, each retaining tooth 94 fits into the circumferentially oriented circular retaining groove 54 in the housing outer surface, whereupon each elastic rotor side portion 92 is biased radially inward such that the retaining tooth 94 is seated in the retaining groove 54. The switch rotor 82 will then remain in a longitudinally stable position on the housing front end 40 until it is forcibly removed.

Figure 7:
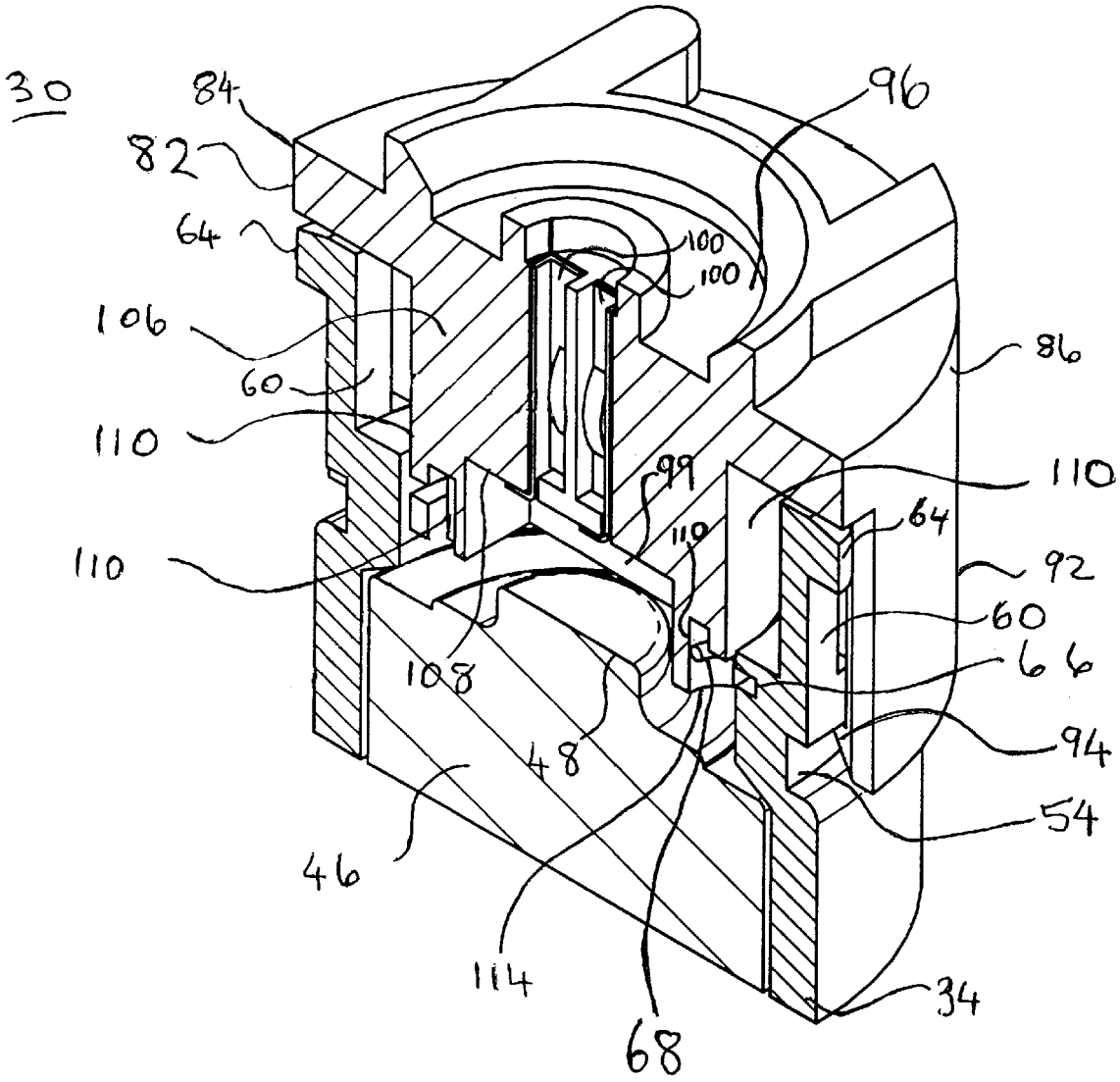
FIG. 7 is a side perspective sectional view of a housing front end and a switch rotor approximated thereto to form a rotary switch in accordance with the present invention.

FIG. 7 is a side sectional perspective view showing the housing front end 40 including the retaining groove 54, the positioning prongs 60 and the position keys 64, and the ground wiper stabilizing groove 66, in which is disposed a deformable, electrically conductive ground wiper 68. Also shown are the rotor 82 including rotor side portions 92 with retaining teeth 94, and rotor front end 84 with rotor front surface 86. The rotor front end 84 forms a centrally located, rearwardly projecting rotor hub 106 having a rotor hub rear surface 108 and a cylindrical rotor hub side surface 110. FIGS. 6 and 7 also show a circuit housing 99 located within the rotor hub 106 and proximate the rotor hub rear surface 108. The circuit housing 99 contains one or more electrical circuits for connection in series between the second bulb lead 105 and the positive button terminal 48 of the storage battery 46.

Figure 8:
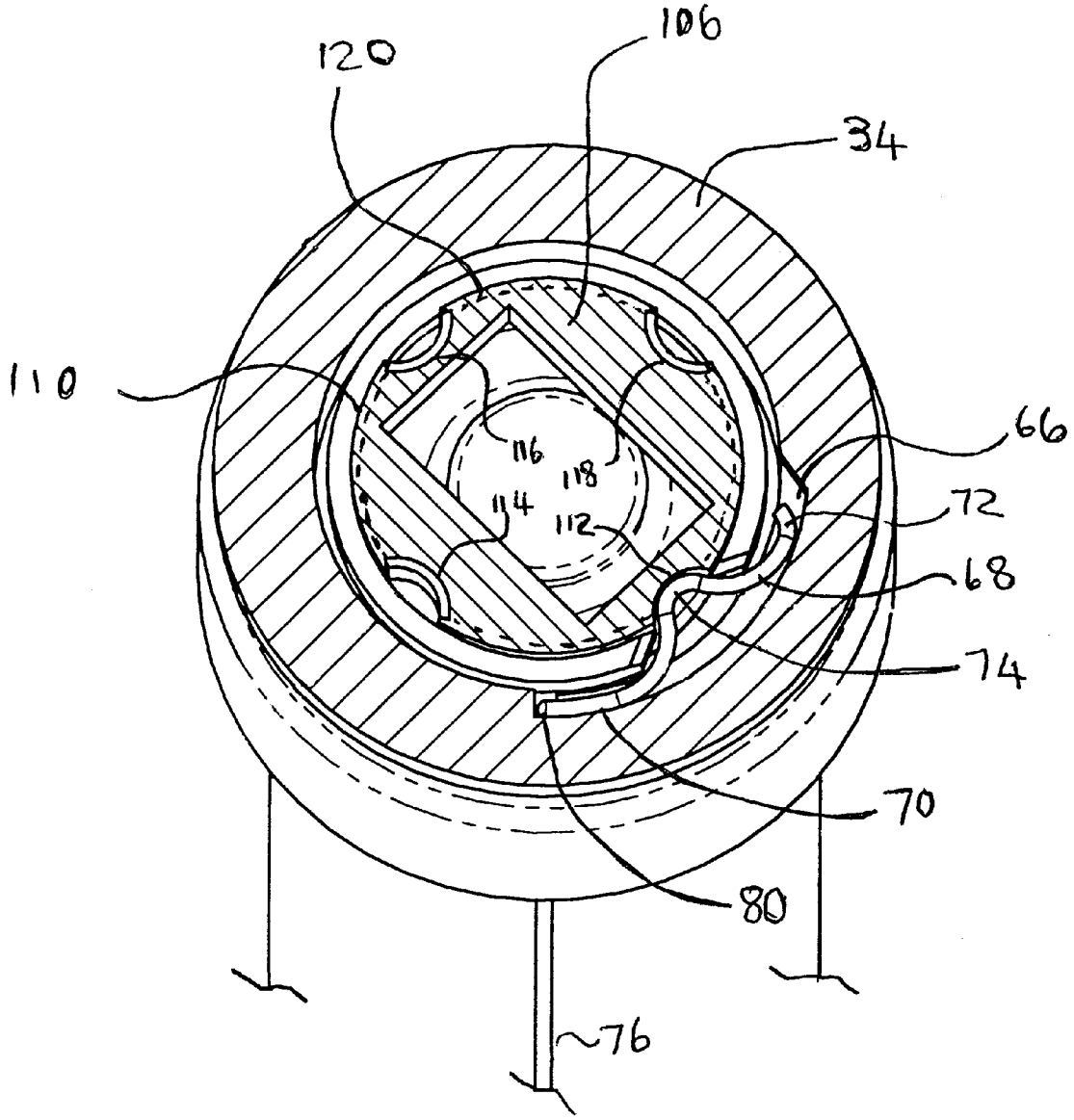
FIG. 8 is a front end perspective sectional view of a housing front end and the rotor hub portion of a switch rotor approximated thereto in a rotary switch in accordance with the present invention.

FIG. 8 is a front end sectional perspective view of the rotor hub 106 positioned within the housing front end 40. With reference to FIGS. 7 and 8, the arcuate, horizontally oriented ground wiper stabilizing groove 66 is shown. The ground wiper 68 has a ground wiper first end 70, a ground wiper second end 72, and a radially inwardly deviating ground wiper middle portion 74. The ground wiper 68 is oriented generally horizontally within the ground wiper stabilizing groove 66 that is formed in the housing inner side surface 36 in the housing front end 40. The ground wiper first end 70 and the ground wiper second end 72 are lodged in the ground wiper stabilizing groove 66. The ground wiper middle portion 74 is biased to a position radially inward of the ground wiper first end 70 and the ground wiper second end 72 and is radially outwardly deformable in response to a force applied to the wiper middle portion 74. The ground wiper first end 70 is electrically connected to the ground wire front end 80.

The rotor hub side surface 110 forms first, second, third and fourth cylindrical concave rotor ground contact surfaces 112, 114, 116, and 118, which are circumferentially spaced-apart at ninety degrees from one another. First rotor ground contact surface 112 is electrically isolated from the first bulb lead 104. Second rotor ground contact surface 114 is electrically connected to the first bulb lead 104 through a conductive electrical element (not shown). Third rotor ground contact surface 116 is electrically connected to the first bulb lead 104 through an intermittently conductive electrical element (not shown). Fourth rotor ground contact surface 118 is electrically connected to the first bulb lead 104 by a resistive electrical element (not shown).

The rotor hub side surface 110 also defines a horizontally oriented circular guiding groove 120. The guiding groove 120 is located on the rotor hub side surface 110 such that, when the rotor 82 is mounted on the housing front end 40, the guiding groove 120 is adjacent the ground wiper stabilizing groove 66 that is formed in the housing inner surface 36. The guiding groove 120 and the ground wiper stabilizing groove 66 cooperate to confine the ground wiper 68 longitudinally while allowing it to move radially. The arc of the ground wiper retaining groove 66 extends circumferentially only far enough to accommodate the ground wiper first end 70 and the ground wiper second end 72, thereby circumferentially (rotationally) stabilizing the ground wiper 68 relative to the housing 34.

Figure 9:
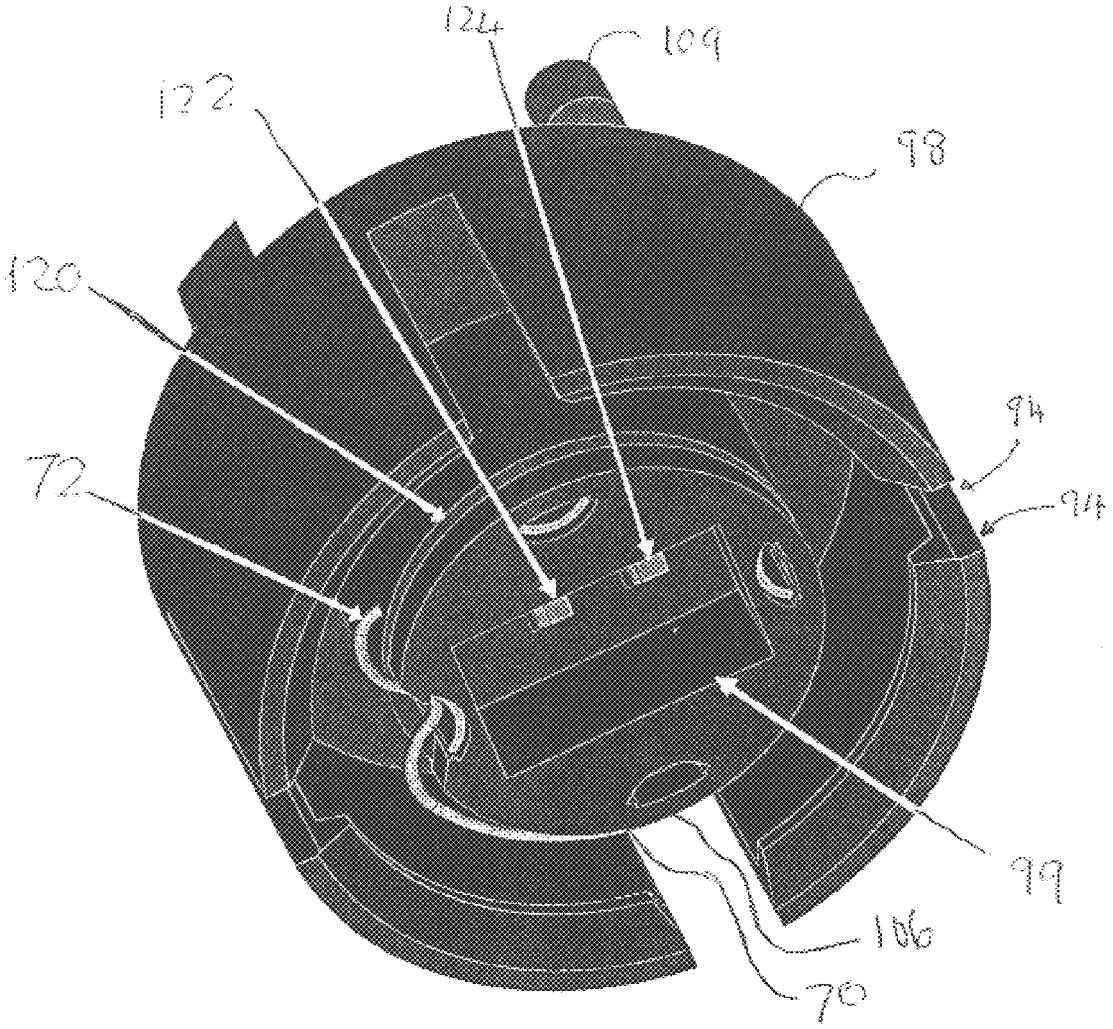
FIG. 9 is a rear end perspective view of a switch rotor of a rotary switch in accordance with the present invention as seen from inside the battery cell housing.

FIG. 9 is a rear end perspective view of the rotor 82 as it would be seen from within the battery cell housing 34. FIG. 9 shows the rotor side portions 92, the engagement tooth 109, the retaining teeth 94, and the rotor hub 106 with the guiding groove 120. As shown in FIG. 9, the circuit housing 99 is defined as a rectangular cavity in the rotor hub rear surface 108. Two conductors 122 and 124 are disposed in the hub rear surface 108 at a location facilitating their electrical contact with one or more electrical leads of a resistor, flasher, or solid state circuit module (not shown) which may be inserted in the circuit housing 99. Such a circuit module would additionally have an electrical battery lead located thereon such that, when the circuit module is inserted in the circuit housing and a battery cell 46 is correctly inserted in the battery cell housing 34, an circuit is established between the positive button battery terminal 48 and at least one of the two conductors 122 and 124.

With reference again to FIGS. 6 and 7, it is seen that because the retaining groove 54 in the housing outer side surface 38 is continuous, the retaining teeth 94 of the rotor side portions 92 are relatively free to slide circumferentially (rotationally) in the retaining groove 54. However, it will be remembered that a position key 64 projects radially outward from the prong distal end 62 of each positioning prong 60 of the battery cell housing 34. Therefore, when the switch rotor 82 is mounted on the housing front end 40 and a rotor side portion 92 is positioned directly radially outward of each position key 64, each position key 64 applies a radially outward force to the corresponding rotor side portion 92. As a result, the position keys 64 are urged radially inward and the positioning prongs 60 are elastically deformed. When the switch rotor 82 is rotationally positioned so that each position key 64 is disposed at an angular position between adjacent rotor side portions 86, each position key 64 projects radially outward into the gap defined between adjacent rotor side portions 86, allowing the positioning prongs 60 to rebound. In this way, the rotor side portions 86 cooperate with the position keys 64 to stabilize the switch rotor 82 in any of four rotational positions relative to the battery cell housing 34.

The first, second, third and fourth rotor ground contact surfaces 112, 114, 116 and 118 are rotationally positioned relative to the rotor side portions 86 such that, when the switch rotor 82 is stabilized in one of the four rotational positions relative to the battery cell housing 34, one of the four rotor ground contact surfaces 112, 114, 116 and 118 is positioned in contact with the ground wiper middle portion 74. Thus, when the switch rotor 82 is rotated from one of these four positions to another relative to the battery cell housing 34, the nature of the electrical connection between the battery negative button terminal and the first bulb lead 104 is altered.

The effect of this altered connection will depend on the nature of the electrical circuit that is contained in the circuit housing 99. The rotary switch 30 in accordance with the present invention is designed to be used in conjunction with a variety of such circuits. In the preferred embodiment that has been described with reference to FIG. 8, first rotor ground contact surface 112 is electrically isolated from the first bulb lead 104 and thus, when the wiper middle portion 74 is positioned on the first rotor ground contact surface 112, no circuit is completed between the ground wire 76 and the bulb. This switch position therefore selectis an "off" function. When the rotor 2 is turned relative to the housing 34 and the wiper middle portion 74 is thus rotated onto the second and subsequent rotor ground contact surfaces, 114, 116, etc., various other functions are selected as various of the circuits that are provided by the circuit module (not shown) are electrically connected between the first bulb lead 104 and the respective rotor ground contact surfaces 114, 116, etc. As a practical matter, an additional electrical conductor (not shown) is disposed on or in the rotor hub portion 106 to connect each of the ground contact surfaces 114, 116, etc. to the circuit module that is to be placed in the circuit housing 99. Each such conductor has a terminal located on a surface of the circuit housing 99. The circuit module must be insertable within the circuit housing 99 and should, ideally, achieve an interference fit or other economical and reliable form of attachment therewith, and must have an electrical lead so located thereon as to contact each of the conductor terminals on the surface of the circuit housing 99.

The battery cell housing and the rotor may be formed of nonconducting materials such as plastics, paper products, textiles, wood, glass, ceramic or the like. The battery cells may be, for example, size "C" or size "A."

In another exemplary embodiment of a rotary switch in accordance with the present invention, the rotor hub portion 106 defines a plurality of up to twenty (20) circumferentially spaced apart rotor ground contact surfaces and the rotor includes up to 20 circumferentially spaced-apart rotor side portions. Similarly, the housing front end 40 defines a plurality of positioning prongs for engagement and cooperation with the rotor in a manner analogous to that already described herein. It will be appreciated that if M is the number of positioning prongs and N is the number of rotor side portions, the adoption of a variety of different angular spacing intervals for the rotor side portions, the positioning prongs, or both can under some circumstances result in a number of positions greater than M or N.

In another exemplary embodiment, the number of rotor ground contacts exceeds the number of positions that is stabilized by the cooperation of the rotor side portions and the positioning prongs. As a result, relatively smooth rotation is provided between several electrically distinct switch positions.

In another exemplary embodiment, the ground wiper contacts and the ground wiper are formed large enough and strong enough to stabilize the rotor in one or more rotational positions relative to the housing as a result of the deformation of the ground wiper.

While the foregoing detailed description has described several embodiments of a rotary switch in accordance with the present invention, it is to be understood that the above description is illustrative only and not limiting of the disclosed invention. It will be appreciated that the embodiments discussed above and the virtually infinite embodiments that are not mentioned could easily be within the scope and spirit of the present invention. Thus, the present invention is to be limited only by the claims as set forth below.

What is claimed is:

1. A rotary switch, comprising:

a housing;

a rotor approximated to said housing;

an electrically conductive wiper disposed on said housing;

an electrically conductive contact surface disposed on said rotor;

said wiper and said contact surface being movable between a first relative position and a second relative position;

an electrical circuit being closed comprising said wiper and said contact surface in series when said wiper and said contact surface are in said first relative position, said electrical circuit being opened when said wiper and said contact surface are in said second relative position;

said housing defining an axis of rotation, said rotor being rotatable about said axis of rotation with respect to said housing to provide said first and second relative positions of said wiper and said contact surface;

said wiper being confined at an angular position about said axis of rotation on said housing, and said contact surface being confined at an angular position about said axis of rotation on said rotor, such that, with rotation of said rotor about said axis of rotation with respect to said housing, said wiper and said contact surface are moved between said first and second relative positions;

said wiper and said contact surface when in said first relative position defining a thrust axis;

said wiper being supported on said housing with respect to said thrust axis, and said contact surface being supported on said rotor with respect to said thrust axis, such that said wiper and said contact surface are urged into mutual electrical contact when in said first relative position;

said housing and said rotor cooperating to provide resistance to rotation of the rotor relative to the housing when said wiper and said contact surface are in said first relative position, whereby said first relative position is stabilized;

said housing defining a position key, said rotor defining a shell, said position key and said shell cooperating to provide resistance to rotation of the rotor relative to the housing when said wiper and said contact surface are in said first relative position.

2. A rotary switch as set forth in claim 1, wherein:

said housing forms a cylindrical end;

said position key projects radially outward from said cylindrical end;

said rotor forms a cylindrical shell;

said rotor is approximated to said cylindrical end; and said position key contacts said shell to provide resistance to rotation of the rotor relative to the housing when said wiper and said contact surface are in said first relative position.

3. A rotary switch as set forth in claim 2, wherein:

said cylindrical end of said housing has an outer surface defining a circumferentially oriented circular retaining groove;

said cylindrical shell of said rotor defines a retaining tooth; and said retaining tooth is approximated to said retaining groove to affix said rotor to said housing.

* * * * *